US011491408B2

(12) United States Patent
Martin et al.

(10) Patent No.: US 11,491,408 B2
(45) Date of Patent: Nov. 8, 2022

(54) AMUSEMENT RIDE SYSTEM

(71) Applicant: Dynamo Industries Inc., Plantagenet (CA)

(72) Inventors: Richard Martin, Cumberland (CA); Jeffrey Beaudin, Dunvegan (CA); Robert Lockhart, Ottawa (CA); William Nathaniel McNair, Orleans (CA); Derek Coopman, Ottawa (CA); Brian Richard Gill, Vankleek Hill (CA); David Anthony Barlow, Rockland (CA); David Roy, L'Original (CA)

( * ) Notice: Subject to any disclaimer, the term of this patent is extended or adjusted under 35 U.S.C. 154(b) by 311 days.

(21) Appl. No.: 16/859,022

(22) Filed: Apr. 27, 2020

(65) Prior Publication Data

US 2021/0106921 A1 Apr. 15, 2021

Related U.S. Application Data

(60) Provisional application No. 62/913,274, filed on Oct. 10, 2019.

(51) Int. Cl.

| | |
|---|---|
| ***A63G 21/20*** | (2006.01) |
| ***A63G 21/22*** | (2006.01) |
| ***A63G 9/12*** | (2006.01) |
| ***A63G 9/04*** | (2006.01) |

(52) U.S. Cl.

CPC ..... *A63G 21/20* (2013.01); *A63G 9/04* (2013.01); *A63G 9/12* (2013.01); *A63G 21/22* (2013.01)

(58) Field of Classification Search

CPC . A63G 21/20; A63G 9/04; A63G 9/12; A63G 21/22; B61B 3/00; B61B 3/02; B61B 7/06; B61B 12/02; E01B 25/00; E01B 25/18; E01B 25/24; E01B 25/26

See application file for complete search history.

(56) References Cited

U.S. PATENT DOCUMENTS

| | | | | |
|---|---|---|---|---|
| 4,957,047 | A * | 9/1990 | Feuz | B61B 12/02 104/211 |
| 9,975,560 | B2 * | 5/2018 | Wieser | B61B 12/02 |
| 10,220,859 | B2 | 3/2019 | Reese | |

(Continued)

FOREIGN PATENT DOCUMENTS

| | | | |
|---|---|---|---|
| FR | 649181 | A2 | 12/1928 |
| FR | 2900834 | A1 | 11/2007 |
| WO | 1998025678 | A1 | 6/1998 |

*Primary Examiner* — Michael D Dennis

(74) *Attorney, Agent, or Firm* — Amster, Rothstein & Ebenstein

(57) ABSTRACT

A bogie configured to move along a track of an amusement ride includes two first lateral wheels, on each side of a vertical center plane of the bogie, for rolling along a run of the track. A second lateral wheel is mounted on each side of the vertical center plane and is movable perpendicular to the vertical center plane between a first position proximate the vertical plane and a second position spaced-away from the vertical plane. The bogie also includes a mechanism that provides a force to normally bias the second wheel toward the first position. The mechanism is configured such that the magnitude of the provided force increases with increasing separation between the second lateral wheel on one side of the vertical center plane and the second lateral wheel on the other side of the vertical center plane.

21 Claims, 15 Drawing Sheets

(56) References Cited

U.S. PATENT DOCUMENTS

| | | | | |
|---|---|---|---|---|
| 2002/0134276 | A1* | 9/2002 | Pabst | B61B 12/02 104/87 |
| 2008/0229967 | A1 | 9/2008 | Lins | |
| 2017/0120935 | A1* | 5/2017 | Reese | A63G 21/20 |

* cited by examiner

AMUSEMENT RIDE SYSTEM

FIELD OF THE INVENTION

The present disclosure relates generally to a playground structure, and more particularly to a track-based or zip line-like amusement ride system for a playground.

BACKGROUND

Track-based or zip line-like playground rides have gained popularity in recent years, at least in part because they offer a fun and exciting playground experience for teenagers and bigger children. Such rides include a track that is supported above a ground surface and a bogie that runs along the track and from which is suspended a rider support, such as for instance a seat or a grip-bar, etc. Gravity and/or pushing is used to propel the bogie from one end of the track to the other, with the rider being carried along below the bogie at some relatively small height above the ground surface.

Of course, safety is a major consideration when designing and installing any type of playground structure, and in particular any playground structure that involves movement along a relatively long stretch of track. U.S. Pat. No. 10,220,859, which issued to Reese et al. on Mar. 5, 2019, describes an amusement ride system in which a bogie moves along a track having a run and a flange extending upwardly from an upper portion of the run. The bogie is designed such that a first type of lateral wheel rolls along the run and a second type of lateral wheel is spaced apart from and aligned with the flange. Rotational motion of the bogie around the track, such as may be caused by lateral swaying of the rider support, causes the second type of lateral wheel to come into contact with and run along the side of the flange, thereby preventing further rotational motion. In this way, the bogie allows only a limited amount of lateral swaying motion of the rider support, and thereby prevents the rider support from sweeping outwardly and hitting a support structure or another person standing beside the ride.

Current track-based or zip line-like amusement ride systems often include one or more sloped track sections, which allow the rider to develop considerable forward speed and momentum. The speed and momentum may be boosted if the rider is also pushed by another person during the course of the ride. It is therefore a concern that the bogie may reach the end of the track and hit a hard stop with considerable force, causing the rider to come to a very sudden and jarring halt. In extreme cases, the rider may be thrown from the ride and may suffer an injury as a result. In the above-mentioned system described by Reese et al. the ends of the track are sloped upward, such that gravity will cause the rider to slow down and lose some momentum before the bogie hits the hard stop at the end of the track. Unfortunately, the upwardly sloped end section of the track may not be sufficient, by itself, to slow the rider to a safe speed if the rider is being pushed by one or more other people.

It would therefore be beneficial to provide methods and apparatuses that overcome at least some of the above-mentioned disadvantages and/or limitations.

SUMMARY

In accordance with an aspect of at least one embodiment there is provided an amusement ride system, comprising: a track having first and second opposite end sections and a central section disposed therebetween, the track comprising a run and a flange extending from an upper portion of the run, the flange having a width within the central section of the track, wherein the width of the flange increases within at least one of the first and second opposite end sections of the track to a maximum flange width; and a bogie configured to move along the track, the bogie having a vertical center plane and having an upper opening extending along a length thereof for accommodating the flange, the bogie comprising: two first lateral wheels rotatably mounted on each side of the vertical center plane, the two first lateral wheels being arranged to roll along the run of the track; a second lateral wheel rotatably mounted on each side of the vertical center plane; and a mechanism configured to normally bias the second lateral wheel on each side of the vertical center plane toward a respective first position that is proximate the vertical center plane and to support a movement of each of the second lateral wheels toward a respective second position that is spaced away from the vertical center plane, wherein the second lateral wheel disposed on one side of the vertical center plane is spaced apart from the second lateral wheel disposed on the other side of the vertical center plane by: a first distance when each second lateral wheel is in its respective first position, and a second distance greater than the first distance when each second lateral wheel is in its respective second position, and wherein the second distance is less than the maximum flange width within the at least one of the first and second opposite end sections.

In accordance with an aspect of at least one embodiment there is provided an amusement ride system, comprising: a substantially rigid track supported above a ground surface by a plurality of supports, the track comprising a plurality of track segments connected together such that adjacent track segments have substantially no freedom of movement relative to each other, and such that a junction between adjacent track segments presents a substantially smooth, continuous, and uninterrupted surface, each track segment comprising a run and a flange extending from an upper portion of the run, the track having first and second opposite end sections and a central section disposed therebetween, wherein the flange has a width that is substantially uniform within the central section of the track and wherein the width of the flange increases within at least one of the first and second opposite end sections of the track from the uniform width to a maximum flange width; and a bogie configured to move along the track, the bogie having a vertical center plane and having an upper opening extending along a length thereof for accommodating the flange, the bogie comprising: two first lateral wheels rotatably mounted on each side of the vertical center plane, the two first lateral wheels being arranged to rotate in a first plane that is oriented at an angle of between about 0° and about 60° relative to the vertical center plane; a second lateral wheel rotatably mounted on each side of the vertical center plane, the second lateral wheel being movable along an arcuate path or along a direction that is generally perpendicular to the vertical center plane, between a first position that is proximate the vertical center plane and a second position that is spaced-away from the vertical center plane; and a mechanism configured to provide a force that normally biases the second lateral wheel toward the first position, wherein the second lateral wheel is arranged to rotate in a second plane that is oriented generally perpendicular to the vertical center plane at least when the second lateral wheel is in the first position, and wherein a space between the second lateral wheel on one side of the vertical center plane and the second lateral wheel on the other side of the vertical center plane increases with the width of the flange when the bogie moves through the at least one of the first and second opposite end sections of the track, and wherein the force provided by the mechanism increases with the increasing space, thereby increasing rolling resistance between the second lateral wheel and the flange.

In accordance with an aspect of at least one embodiment there is provided a bogie configured to move along a track of an amusement ride, the bogie having a vertical center plane thereof, the bogie comprising: two first lateral wheels rotatably mounted on each side of the vertical center plane, the two first lateral wheels being arranged to rotate in a first plane that is oriented at an angle of between about 0° and about 60° relative to the vertical center plane; a second lateral wheel rotatably mounted on each side of the vertical center plane, the second lateral wheel being movable along an arcuate path or along a direction that is perpendicular to the vertical center plane, between a first position that is proximate the vertical center plane and a second position that is spaced-away from the vertical center plane, the second lateral wheel being arranged to rotate in a second plane that is oriented generally perpendicular to the vertical center plane at least when the second lateral wheel is in the first position; and a mechanism configured to provide a force that normally biases the second wheel toward the first position, and wherein the mechanism is further configured such that the magnitude of the provided force increases with increasing separation between the second lateral wheel on one side of the vertical center plane and the second lateral wheel on the other side of the vertical center plane.

BRIEF DESCRIPTION OF THE DRAWINGS

The invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the disclosure and is provided in the context of a particular application and its requirements. The drawings are intended to be illustrative and are not drawn to scale. Various modifications to the disclosed embodiments will be readily apparent to those skilled in the art, and the general principles defined herein may be applied to other embodiments and applications without departing from the scope of the disclosure. Thus, the present disclosure is not intended to be limited to the embodiments disclosed but is to be accorded the widest scope consistent with the principles and features disclosed herein.

In the description and in the appended claims, the expression "generally perpendicular to the vertical center plane" means plus or minus 10°, preferably plus or minus 5°, from perpendicular to the vertical center plane.

In the description and in the appended claims, the expression "movable along an arcuate path or along a direction that is generally perpendicular to the vertical center plane" includes both a linear translational movement within a plane that is plus or minus 10°, preferably plus or minus 5°, from perpendicular to the vertical center plane, as well as a pivoting movement through an arc that is away from and toward the vertical center plane, wherein a tangent to the arc varies between plus or minus 10°, preferably plus or minus 5°, from perpendicular to the vertical center plane during the pivoting movement.

Figure 1:
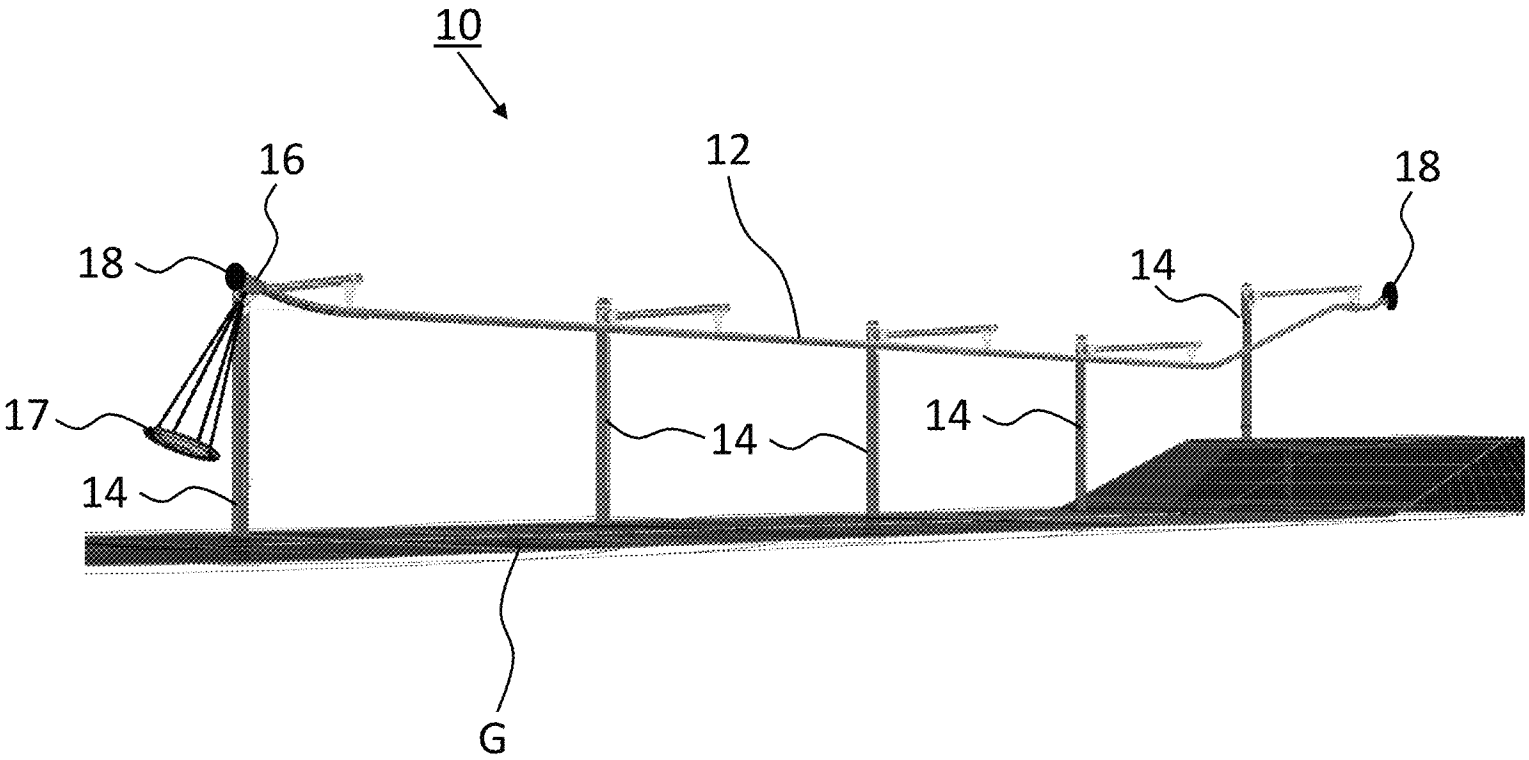
FIG. 1 is a simplified perspective view of an amusement ride system for a playground, according to an embodiment.

Referring to FIG. 1, shown is a simplified diagram of an amusement ride system 10 for a playground. The system 10 includes a substantially rigid track 12 supported above the ground G by a plurality of supports 14. A bogie 16 slides along the track 12 for transporting riders on a rider support 17. The track 12 can be provided with stops 18 at opposite ends thereof to prevent the bogie 16 from coming off the track 12. The supports 14 are all shown on the same side of track 12 in FIG. 1, but alternatively some of the supports 14 may be disposed on one side of track 12 and other of the supports 14 may be disposed on the other side of the track 12.

Figure 2A:
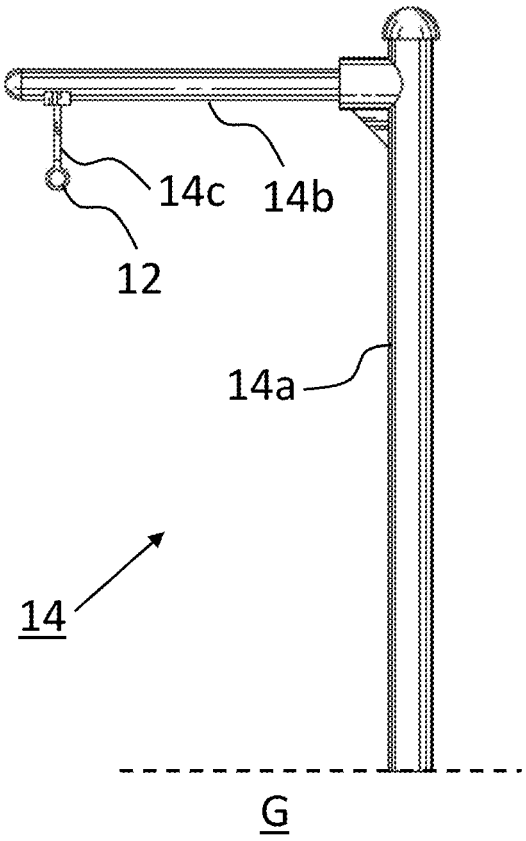
FIG. 2A is a simplified side view of a support suitable for use with the amusement ride system of FIG. 1, shown supporting a track segment.
Figure 2B:
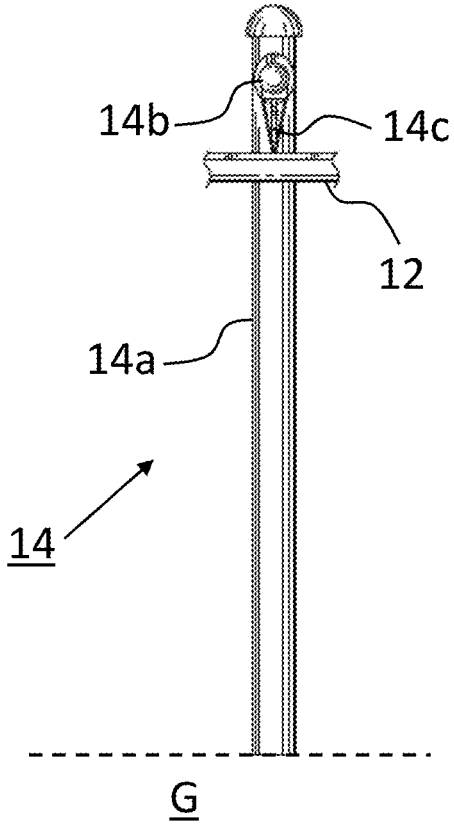
FIG. 2B is a simplified front view of the support of FIG. 2A.
Figure 2C:
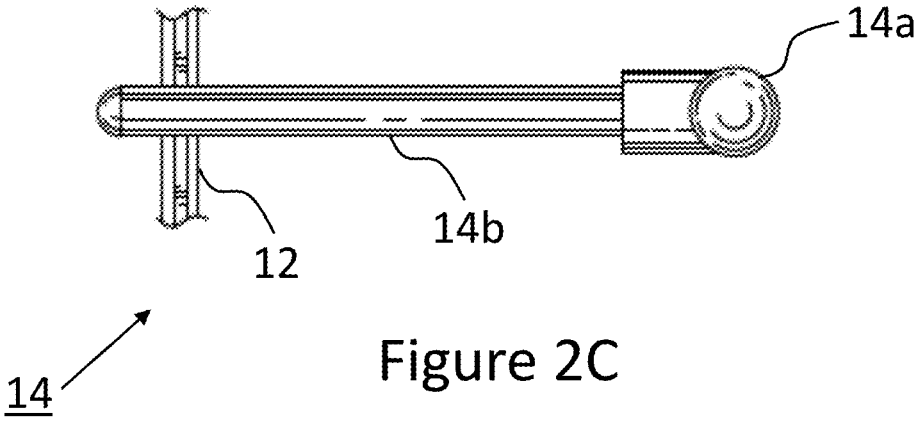
FIG. 2C is a simplified top view of the support of FIG. 2A.

An exemplary support structure 14 for supporting the track 12 above the ground surface G is shown in FIGS. 2A-C. The support structure 14 includes a generally vertical portion 14*a* which extends up from the ground G. A generally horizontally extending section 14*b* extends from the generally vertical portion 14*a*. A mounting structure 14*c* is provided at the distal end of the generally horizontally extending section 14*b*. The mounting structure 14*c* is shown in FIGS. 2A and 2B to be more or less "V-shaped." As is shown in FIGS. 2A-C and in FIG. 1, the track 12 is suspended from (and is thus below) the distal end of the generally horizontally extending section 14*b*.

Alternative support structures may readily be envisaged, such as for instance a not illustrated "T-shaped" double-support having a second generally horizontally extending section and a second mounting structure. Such a double-support may support two tracks 12, one on each side of the generally vertical portion. The generally horizontally extending sections may be arranged directly opposite one another on the generally vertical portion such that each of the two tracks 12 is identical, or the generally horizontally extending sections may be arranged at different heights such that the two tracks are not configured identically. For instance, the overall drop along one of the tracks may be less than the overall drop along the other track, such that lower maximum speeds are achieved. Such an arrangement may be used to provide separate rides for younger children and for older children along the same series of supports, or simply to provide rides having different configurations, thereby maximizing the utilization of available space.

Figure 3A:
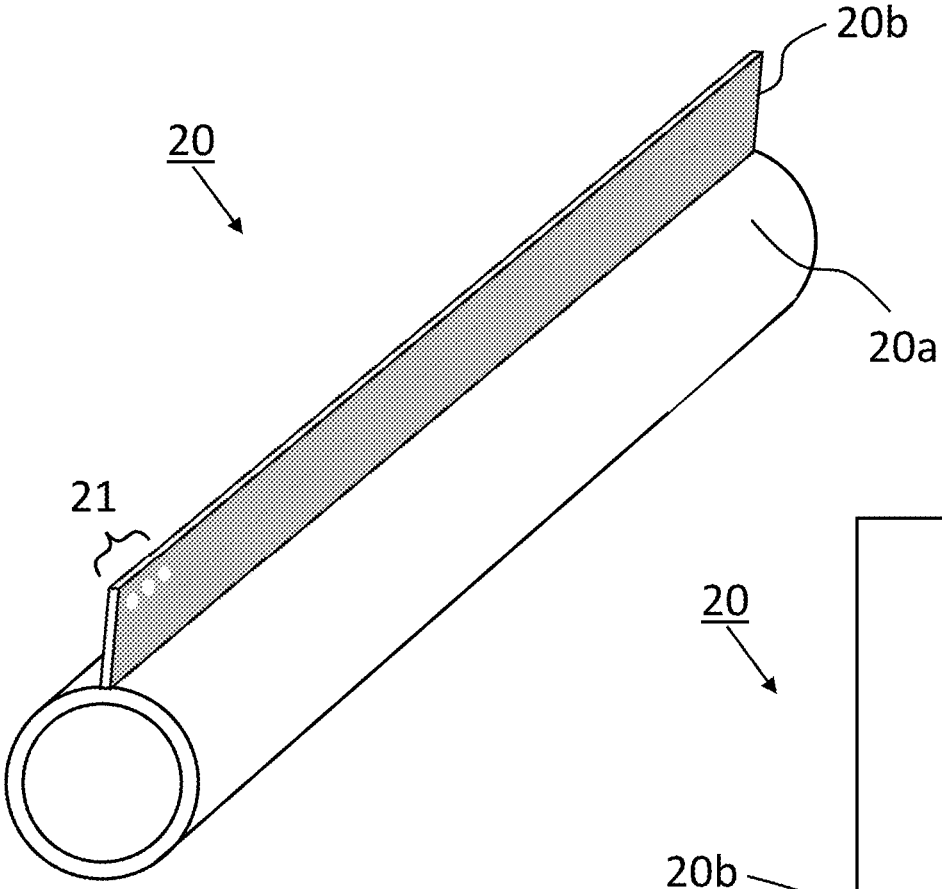
FIG. 3A is a simplified perspective view of a track segment suitable for use with the amusement ride system of FIG. 1.
Figure 3B:
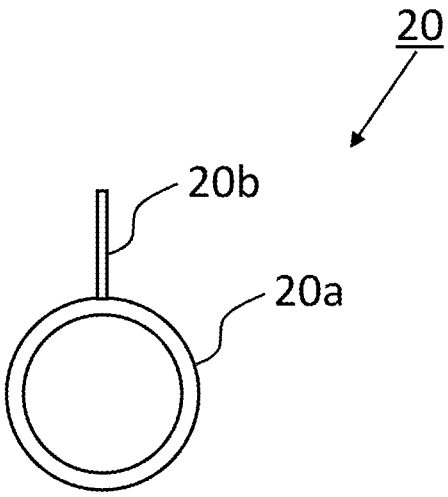
FIG. 3B is a simplified end view of the track segment of FIG. 3A.
Figure 3C:
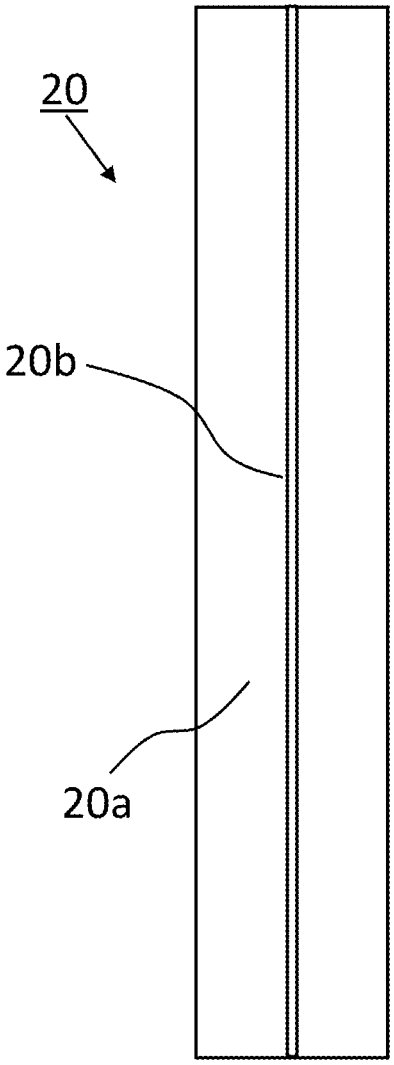
FIG. 3C is a simplified top view of the track segment of FIG. 3A.

Referring now to FIGS. 3A-C, shown are a perspective view, an end view and a top view, respectively, of an individual track segment 20. The illustrated track segment 20 is straight, however the track segment 20 may alternatively be curved left-to-right or curved up-and-down, or both. Assembling together track segments 20 of different shapes and/or different lengths allows different configurations of the track 12 to be formed, such as for instance to accommodate different budgets and/or different site requirements, etc.

The track segment 20 includes a run 20*a* with a flange 20*b* extending upwardly from the run 20*a*, and which extends along the entire length of the run 20*a*. The track segment 20 further includes a mounting structure, such as for instance a plurality of through-holes 21 formed in the flange 20*b*, to facilitate connection of the track segment 20 to the mounting structure 14*c* of the supports 14. For instance, the mounting structure 14*c* has a lower edge that can be bolted to the flange 20*b* via the through-holes 21.

In the specific example that is shown in FIGS. 3A-C the run 20*a* is in the form of a cylindrical tube. Optionally, the tube of the run 20*a* can be formed in any desired shape. Thus, the run 20*a* can, for example, be oval or polygonal. Alternatively, the run could define a segment of a circle, and could, for example, in cross-section define an arc of 180°, 270°, etc.

The track segment 20 is preferably metal, and can be formed, for example, from steel. The track run can be formed from tube stock, such as by extruding or bending. The flange 20*b* may be made from the same material as the run and may be formed separately from the run 20*a* and then fixed to the run, for example, by welding. Alternatively, the run and flange can be formed integrally, for example in an extrusion or pultrusion process. As another alternative, the track segment 20 can be formed from appropriately engineered materials or any other material which will withstand the environment in which the track segments will be placed and the use to which they will be subjected.

Figure 4A:
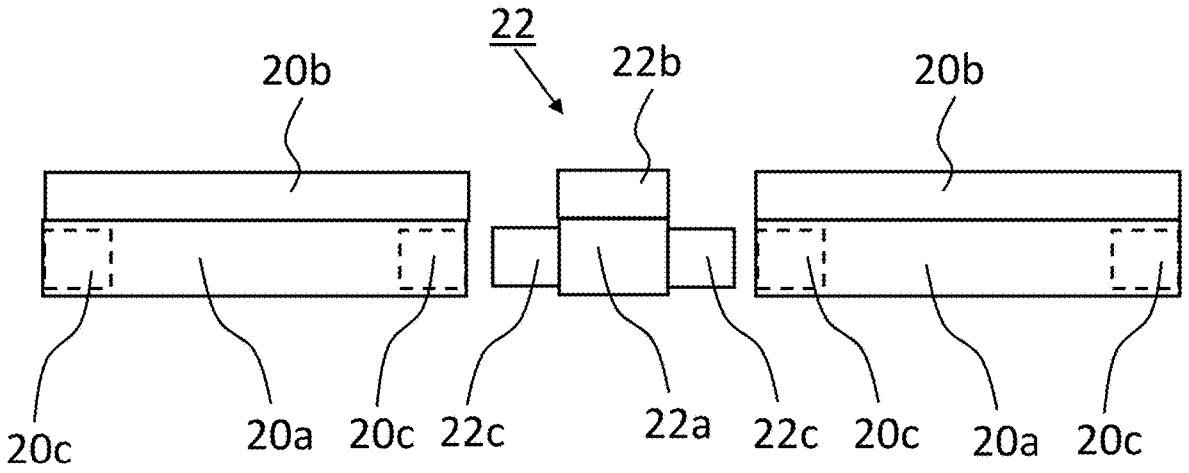
FIG. 4A shows two track segments in an uncoupled condition, prior to being coupled using a connector.
Figure 4B:
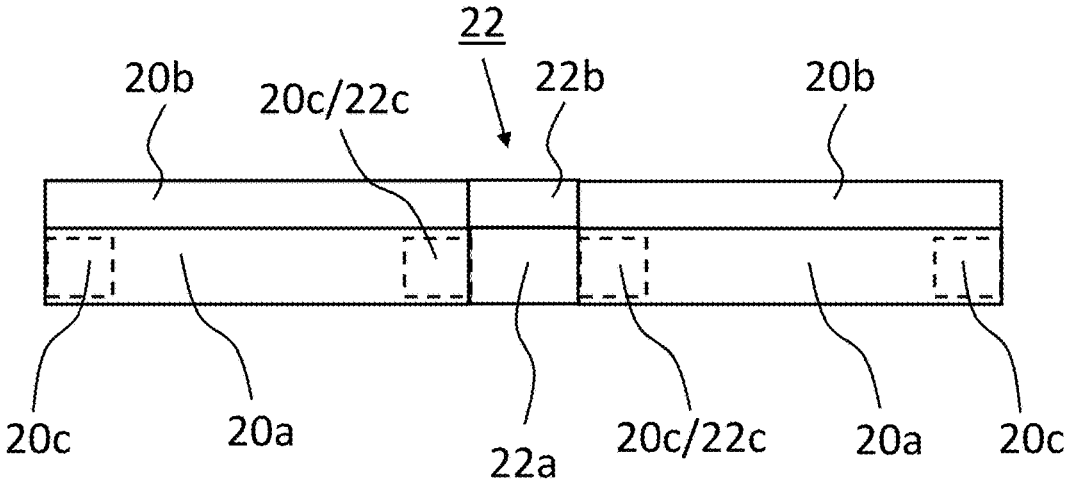
FIG. 4B shows the two track segments of FIG. 4A in a coupled condition, after being coupled using the connector.

Now referring to FIGS. 4A and 4B, a connector 22 may be used to connect together two adjacent track segments 20. The connector 22 has a run 22*a* and a flange 22*b*, and the outside diameter of the connector 22 is the same as the outside diameter of the track segments 20, such that the runs 20*a*-22*a*-20*a* form a substantially smooth and continuous surface. Similarly, the connector 22 also has a flange 22*b* dimensioned similarly to the flanges 20*b* of the two track segments 20. The connector 22 can be made of a metal, plastic, rubber, or any other suitable material. As shown in FIG. 4A each track segment 20 is hollow at least at its opposite ends to provide a recess 20*c* for receiving a neck 22*c* of the connector 22. The inside diameter of the recess 20*c* and the outside diameter of the neck 22*c* are substantially the same, such that the neck 22*c* may be slip fit within the recess 20*c* and the resulting connection permits very little relative movement between the connected pieces. After being assembled as shown in FIG. 4B, mechanical fasteners or other suitable joining means may be used to secure the track segments 20 and connecter 22 together, such as for instance by bolting, riveting or welding together etc. Optionally, the track segments 20 are hollow along the entire lengths thereof.

Figure 5A:
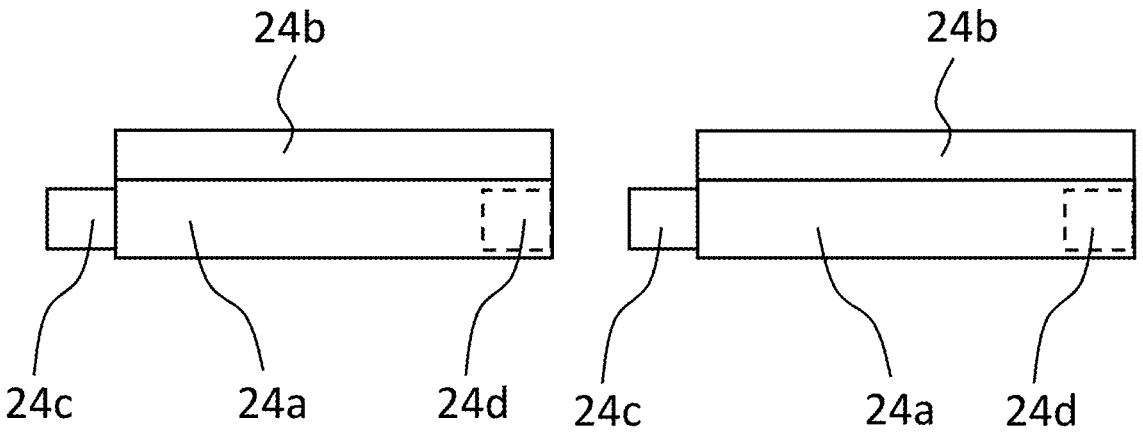
FIG. 5A shows two track segments in an uncoupled condition, prior to being coupled without using a connector.
Figure 5B:
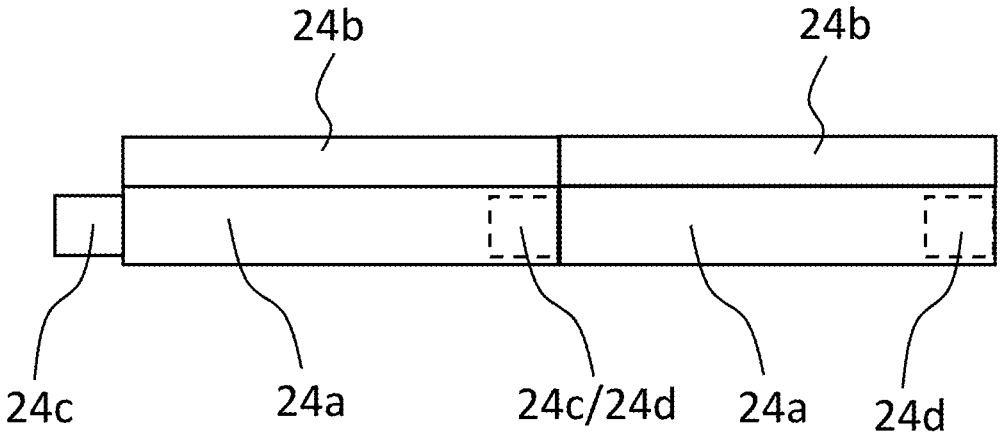
FIG. 5B shows the two track segments of FIG. 5A in a coupled condition.

In an alternative approach that is shown in FIGS. 5A and 5B, two track segments 24 are coupled together without the use of a separate connector. Each track segment 24 includes a run 24*a* and a flange 24*b* similar to the track segment 20 described above. However, the two opposite ends of track segments 24 are not identical. Rather, one end of track segment 24 forms a neck 24*c* and the other end of track segment 24 is hollow to define a recess 24*d* for receiving the neck 24*c* of an adjacent track segment 24. The inside diameter of the recess 24*d* and the outside diameter of the neck 24*c* are substantially the same, such that the neck 24*c* may be slip fit within the recess 24*d* and the resulting connection permits very little relative movement between the connected pieces. After being assembled as shown in FIG. 5B, mechanical fasteners or other suitable joining means may be used to secure the track segments 24 together, such as for instance by bolting, riveting or welding together etc. Optionally, the track segments 24 are hollow along the entire lengths thereof.

Of course, various other approaches may be envisaged for connecting together the track segments 20 or 24 to form a complete track 12. Regardless of the approach that is taken to connect together the track segments 20 or 24, the track 12 will present a substantially smooth, continuous and uninterrupted surface to the bogie 16.

Track segments 20 or 24 are intended for use within a central section of track 12, within which the upwardly extending flange has a substantially uniform width. The substantially uniform width of the flange is selected such that lateral wheels that are carried by the bogie 16 are spaced away from the flange when the bogie travels along the middle portion of track 12 and is oriented substantially vertically. Alternatively, some lateral wheels carried by the bogie 16 may "lightly" touch the flange when the bogie travels along the middle portion of track 12 and is oriented substantially vertically. If a rider suspended below the bogie 16 induces a lateral swaying motion of the rider support 17, then the bogie 16 will tilt as it continues to roll along the run of the track and, as described in more detail below, the lateral wheels that are carried by the bogie 16 will come into contact with and run along one of the side surfaces of the flange, thereby limiting the extent of rotational travel of the bogie 16 on the track 12. Within the central section of the track 12, the upwardly extending flange performs a primary function of limiting the swaying motion of the rider support 17.

Referring now to FIGS. 6A-E, shown are views of an end-segment 50 of the track 12 of the amusement ride system 10. The end-segment 50 may be provided at only one end of the track 12, but in a preferred implementation each end of the track 12 terminates with an end-segment 50. In the specific example that is shown in FIGS. 6A-E the end-segment 50 is substantially straight, but alternatively the end-segment 50 may be curved upwardly such that gravity acts to slow the rider as the bogie approaches the end of the track 12.

Figure 6A:
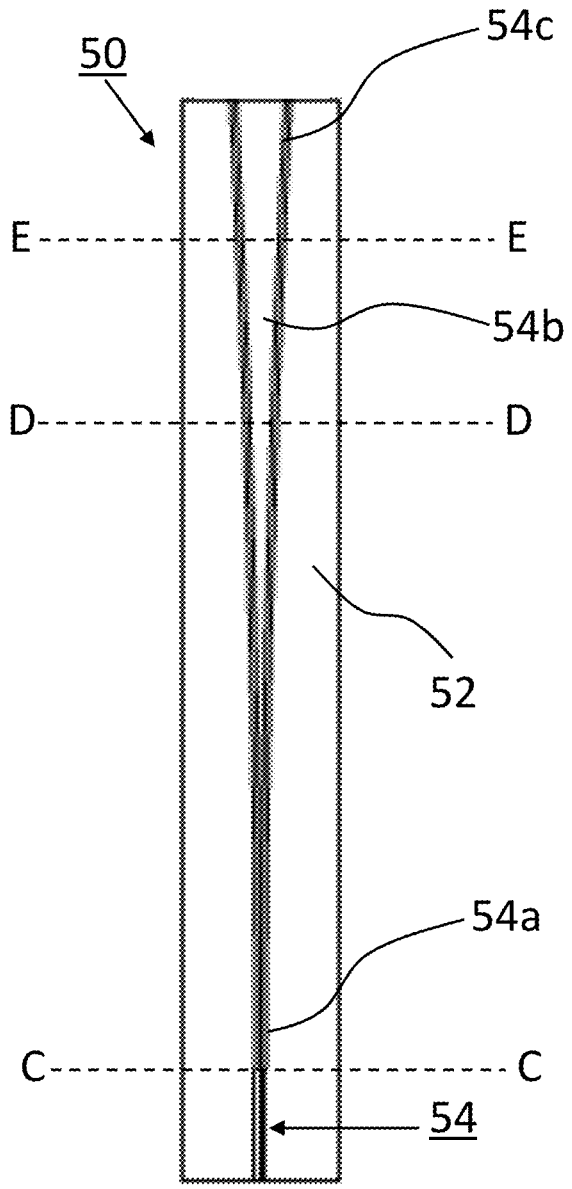
FIG. 6A shows a top view of a track end-segment.

FIG. 6A is a top view of the end-segment 50, which includes a run 52 and a flange that is shown generally at 54. The flange 54 has an initial width at a first end 54*a* that is substantially the same as the width of the flange 20*b* or 24*b* of the track segments 20 or 24 within the central section of the track 12. Similarly, the run 52 has an outside diameter that is substantially the same as the outside diameter of the run 20*a* or 24*a* of the track segments 20 or 24 within the central section of the track 12. As such, there is a substantially smooth transition from the central section of track 12 to the end-segment 50.

Figure 6B:
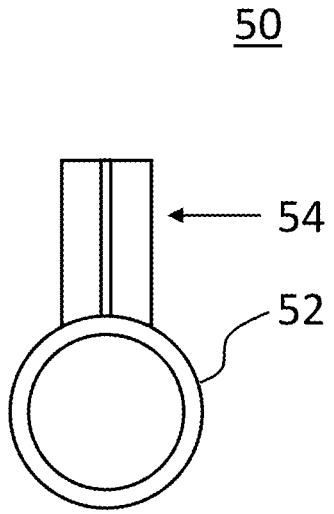
FIG. 6B shows an end view of the track end-segment of FIG. 6A.
Figure 6C:
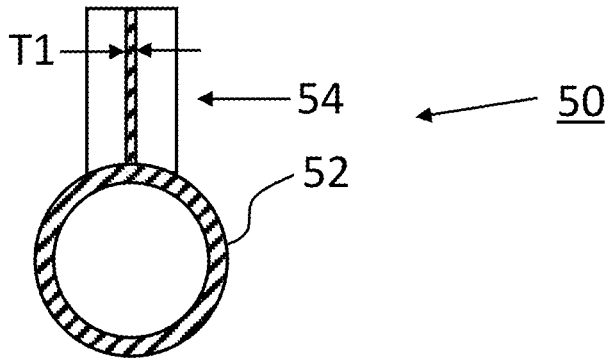
FIG. 6C shows a cross-sectional view of the track end-segment of FIG. 6A taken along the line C-C.
Figure 6D:
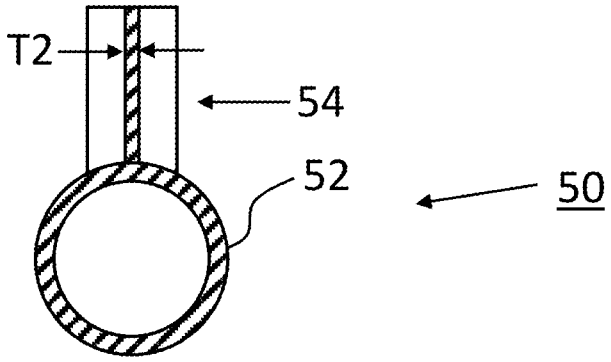
FIG. 6D shows a cross-sectional view of the track end-segment of FIG. 6A taken along the line D-D.
Figure 6E:
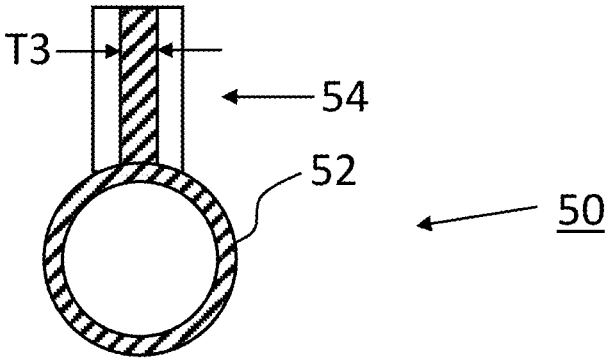
FIG. 6E shows a cross-sectional view of the track end-segment of FIG. 6A taken along the line E-E.

The width of the flange 54 increases within intermediate region 54*b* to a maximum flange width at a second end 54*c*. The flange 54 is therefore substantially wedge-shaped when viewed end on, as is shown in FIG. 6B. FIGS. 6C-E show cross-sectional views that are taken in planes normal to the length of the end-segment 50, at the locations denoted by the respective lines C-C, D-D and E-E in FIG. 6A. The width of the flange 54 increases from T1, to T2 which is greater than T1, and then to T3 which is greater than T2, along the length of the end segment 50. As is described in more detail below, the flange 54 is configured such that passive braking occurs when the bogie 16 moves from the first end 54*a* through the intermediate region 54*c* and toward the second end 54*d*, thereby slowing the bogie 16 before it reaches the end of the track 12.

Figure 7:
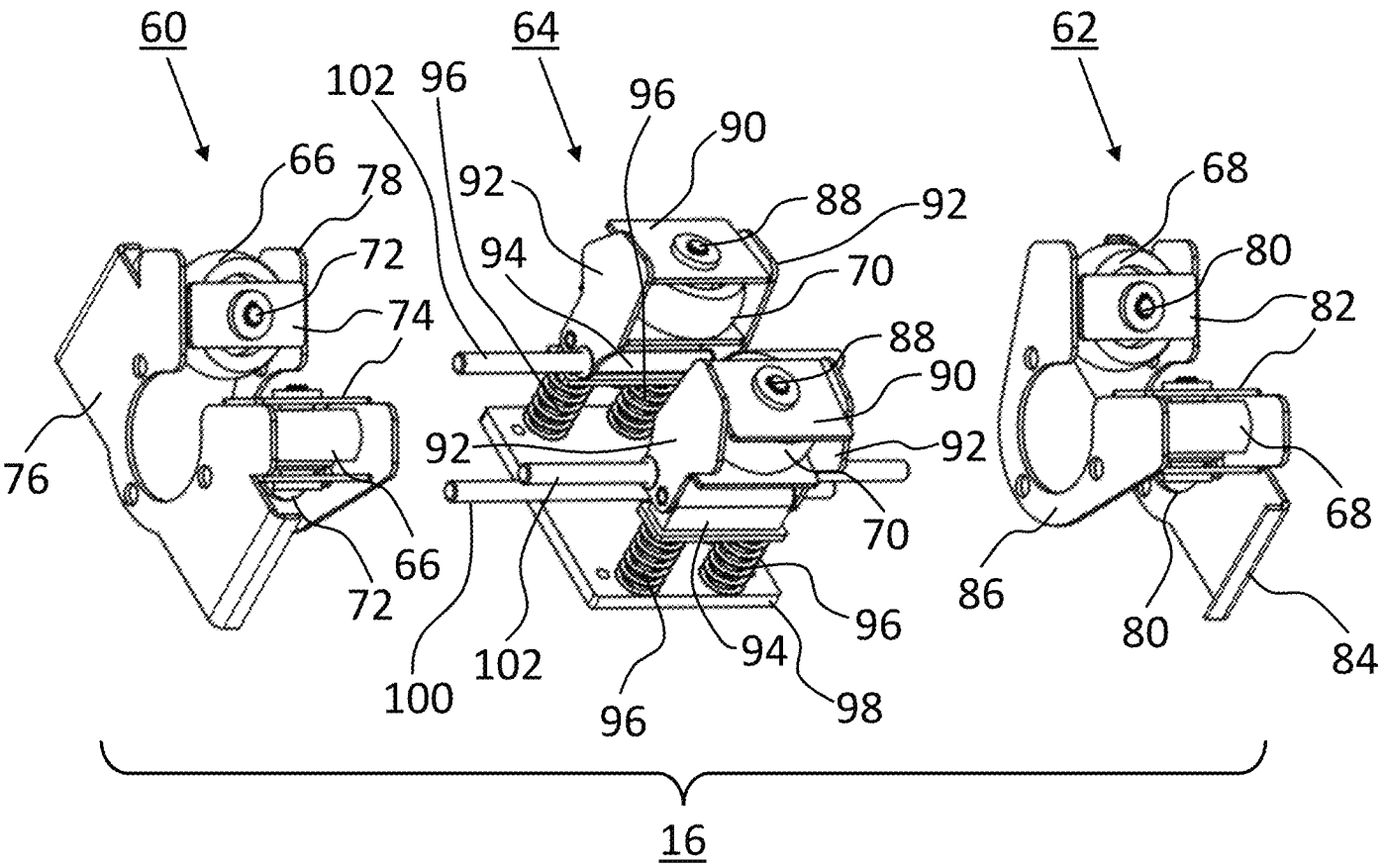
FIG. 7 is an exploded view of a bogie that is suitable for use with the amusement ride system of FIG. 1, shown without an external housing.
Figure 8:
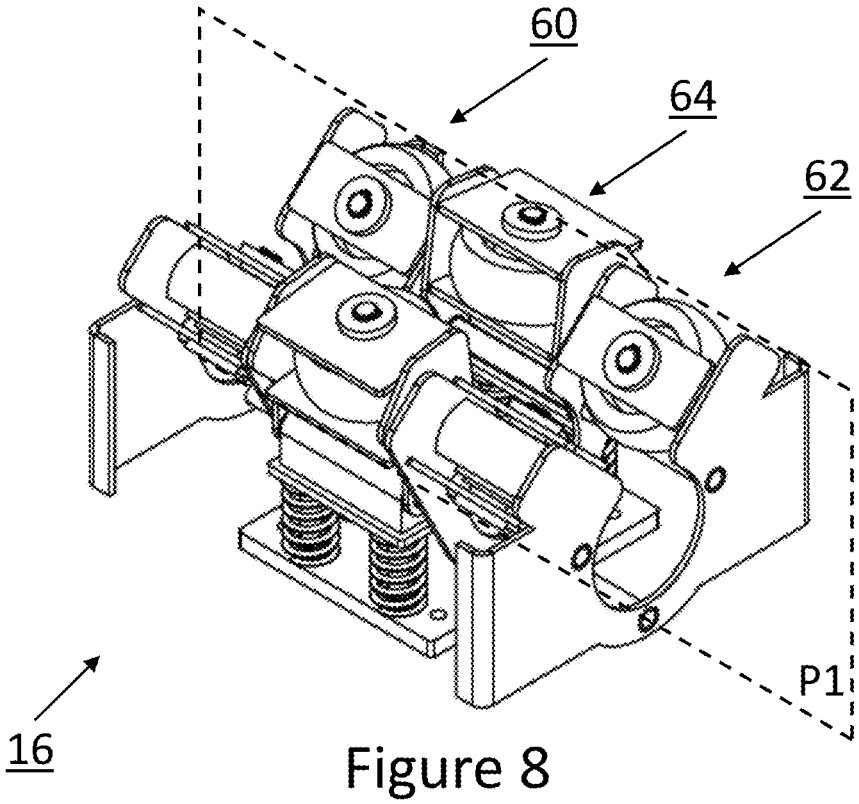
FIG. 8 is a simplified perspective view of the bogie of FIG. 7.
Figure 9:
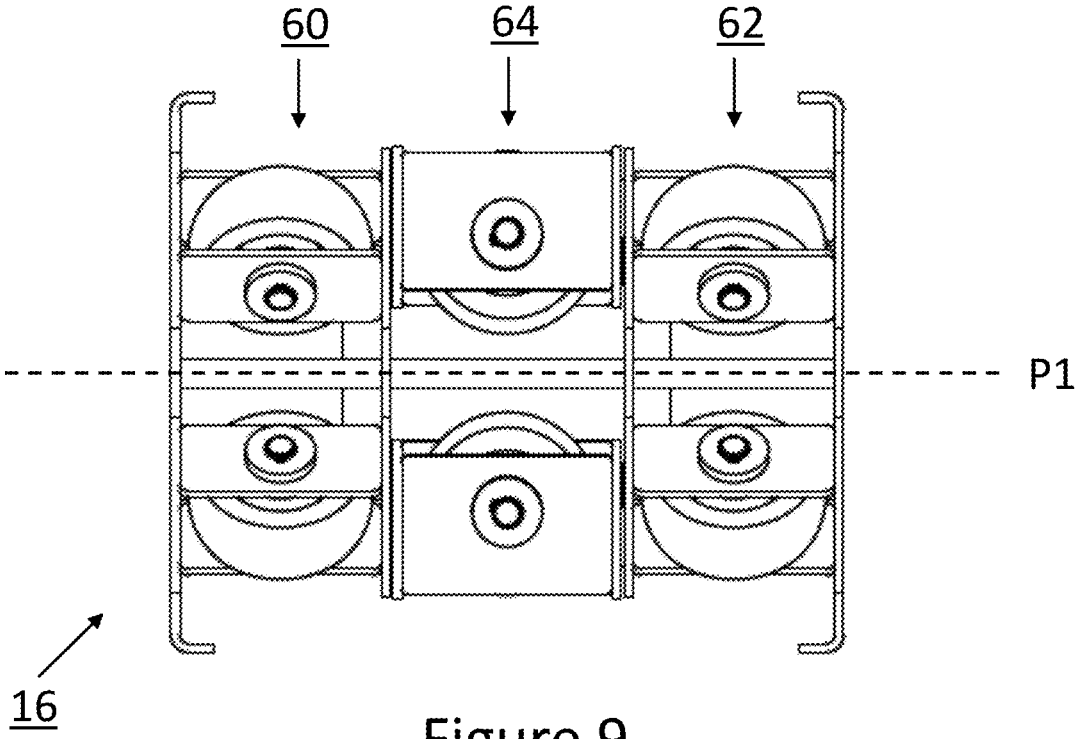
FIG. 9 is a simplified top view of the bogie of FIG. 7.
Figure 10:
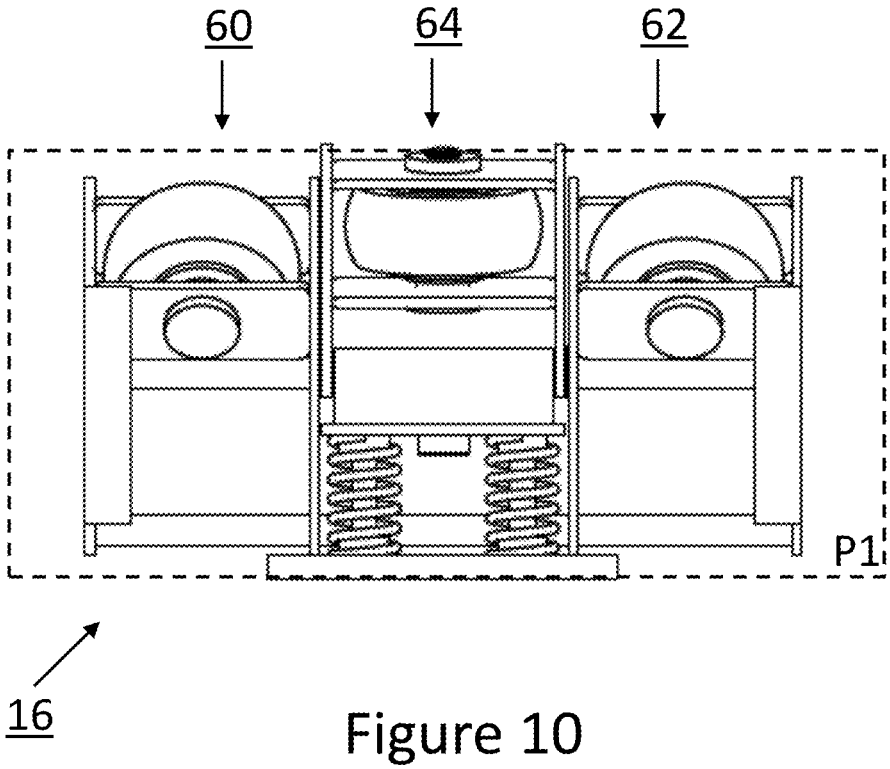
FIG. 10 is a simplified side view of the bogie of FIG. 7.

Referring now to FIG. 7, shown is an exploded view of a bogie 16 that is suitable for use with the amusement ride system 10 of FIG. 1. The bogie 16 is shown without an external housing in order to better illustrate the internal components thereof. During use, a plastic or a metal housing at least partially encloses the bogie 16 for safety reasons and also to prevent sand and other contaminants from damaging the internal components thereof.

In the specific example that is shown in FIG. 7, the bogie 16 includes first and second end subassemblies 60 and 62 and a middle subassembly 64. The first end subassembly 60 includes a pair of first lateral wheels 66 rotatably mounted, via respective axles 72, to first lateral wheel surfaces 74 that are disposed between, and that are supported by, an end plate 76 and an inner wall 78. Similarly, the second end subassembly 62 includes a pair of first lateral wheels 68 rotatably mounted, via respective axles 80, to first lateral wheel surfaces 82 that are disposed between, and that are supported by, an end plate 84 and an inner wall 86.

The middle subassembly 64 includes a pair of second lateral wheels 70 rotatably mounted via a respective axle 88 to second lateral wheel surfaces 90 that are disposed between, and that are supported by, vertical supports 92. The vertical supports 92 are pivotably coupled to a base element 94, the base element 94 is mounted onto a support plate 98 via a pair of compression springs 96. A first connector rod 100 extends from each end of the support plate 98 in a direction along a length of the bogie 16. In addition, a second connector rod 102 extends from each of the vertical supports 92 and in a direction parallel to the first connector rod 100. The connector rods 100 and 102 are received within openings through the inner walls 78 or 86 and through the end plates 76 or 84, and are held in place using a suitable fastener or by forming a weld. The vertical supports 92 are therefore pivotably mounted to the first and second end assemblies 60 and 62 and also pivotably mounted to the base element 94, such that a pivoting movement of the second lateral wheels 70 causes the base element 94 to move toward the support plate 98 and thereby compress the compression springs 96. The compression springs 96 exert a restoring force on the base element 94, the magnitude of which increases as the second lateral wheels 70 continue to pivot and compress the compression springs 96. Optionally, a not illustrated track is mounted to the plate 98 to guide the base element 94, so as to ensure vertical motion of base element 94 along the direction of compression of compression springs 96.

The bogie 16 includes a not illustrated mounting structure for coupling with a complementary mounting structure of a rider support 17. The rider support 17 may optionally take the form of a seat or disc that is capable of supporting a single rider or a plurality of riders, or the rider support 17 may take the form of a ring or a T-bar that is gripped by the rider, etc.

Figure 11:
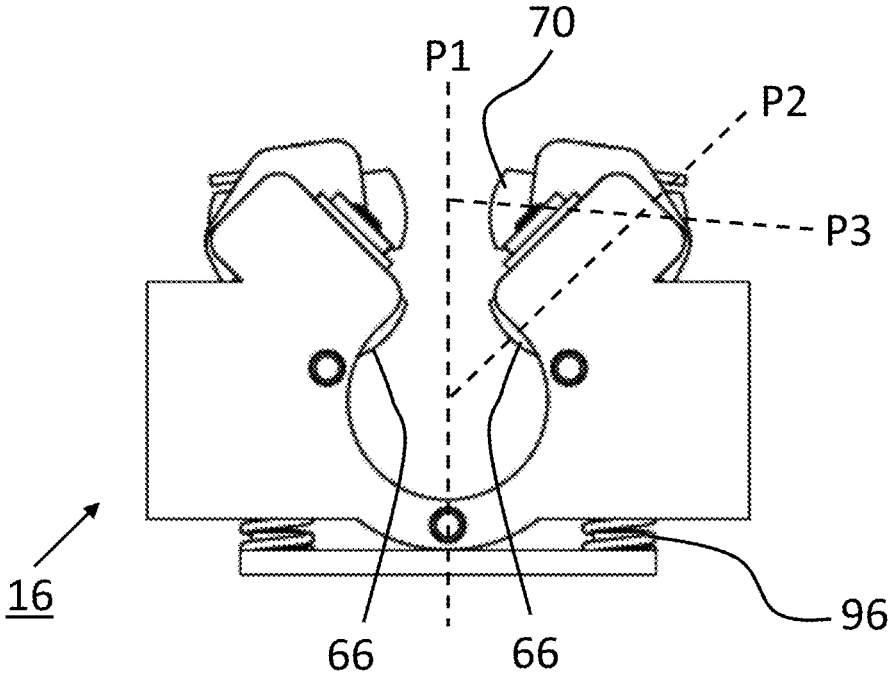
FIG. 11 is a simplified end view of the bogie of FIG. 7.

As is shown in FIGS. 8, 9, 10 and 11, which are perspective, top, side and end views of the bogie 16, respectively, the first lateral wheels 66 and 68 and the second lateral wheels 70 are mounted in an overall arrangement that is generally symmetric about a vertical center plane P1. Referring specifically to FIG. 11, the first lateral wheels 66 and 68 are arranged for rotation in fixed planes P2, which are inclined relative to the vertical center plane P1 by about 60°. However, the first lateral wheels 66 and 68 may be arranged to rotate in a plane that forms a different angle with the vertical center plane P1, such as for instance an angle between 0° and 60°. The angle may be selected based on inter alia the cross-sectional shape of the track 12.

The second lateral wheels 70 are mounted to the bogie 16 so as to be pivotable in a direction that is generally perpendicular to the vertical center plane P1. More particularly, the second lateral wheels 70 are pivotably movable between a first position, in which there is a minimum separation between the second lateral wheels 70 on the opposite sides of the vertical center plane P1, and a second position, in which there is a maximum separation between the second lateral wheels 70 on the opposite sides of the vertical center plane P1. FIGS. 8-11 show the second lateral wheels 70 in the second position, in which they rotate within a plane P3 that is approximately normal to the vertical center plane P1, more particularly plane P3 is angled downwardly by a small angle less than 10° and preferably less than 5°.

Figure 12:
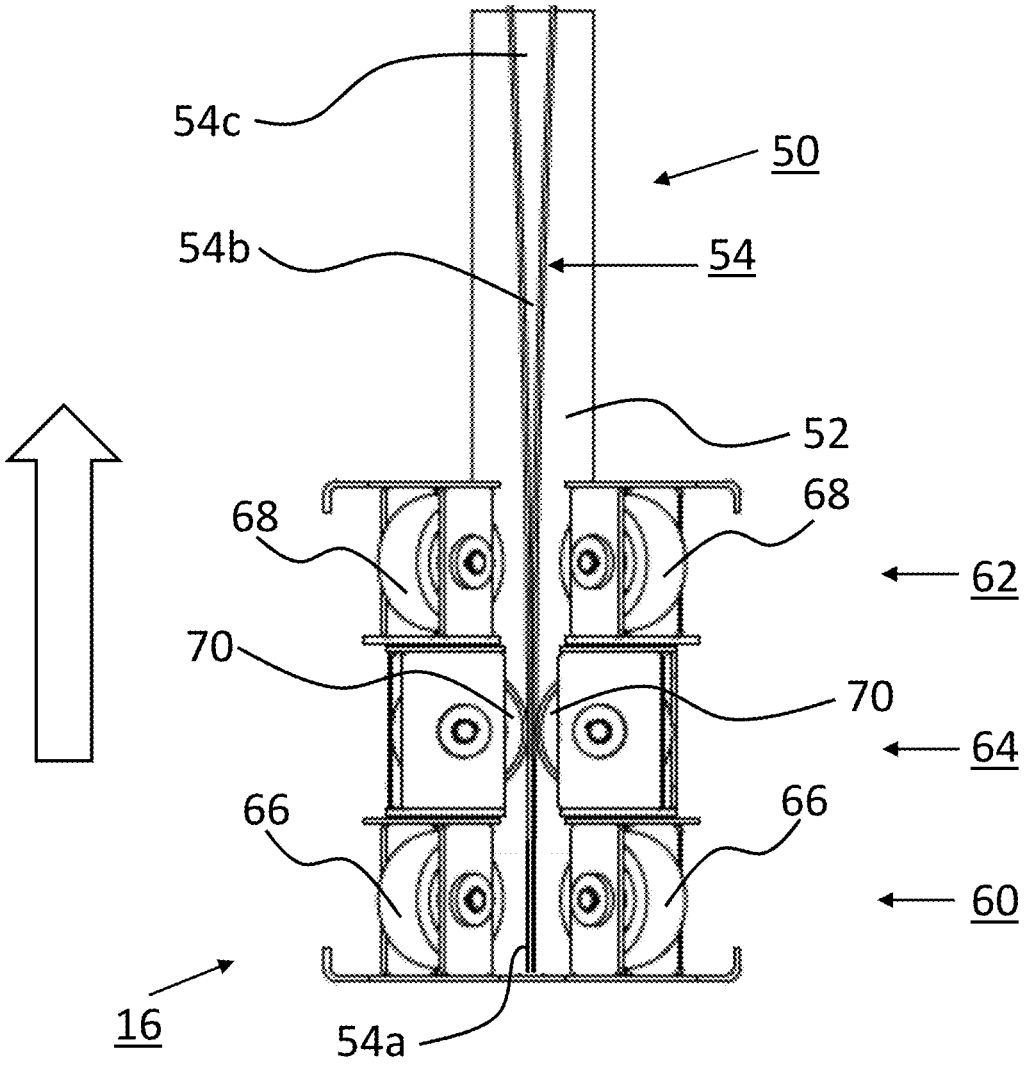
FIG. 12 is a top view of the bogie of FIG. 7 mounted to a track end-segment having a flange of non-uniform width, at a first distance away from the end of the track end-segment along a direction of travel indicated by the block arrow.
Figure 13:
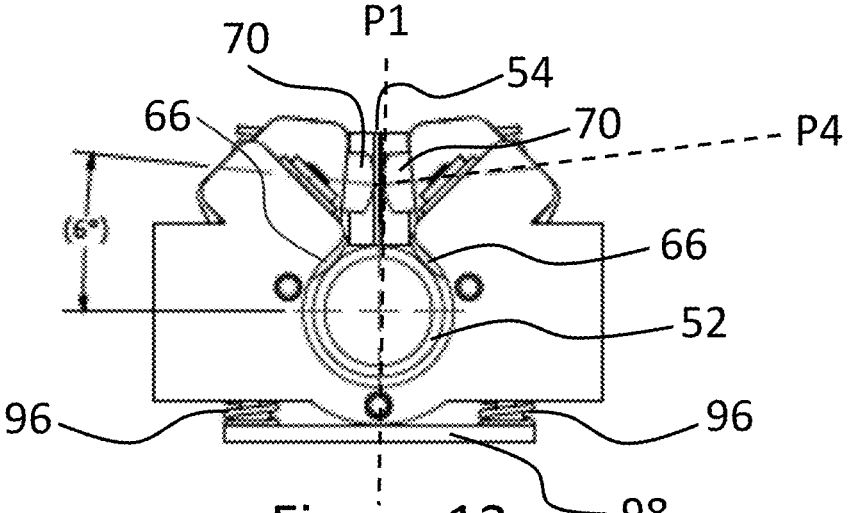
FIG. 13 is an end view of the bogie at the first distance away from the end of the track end-segment.
Figure 14:
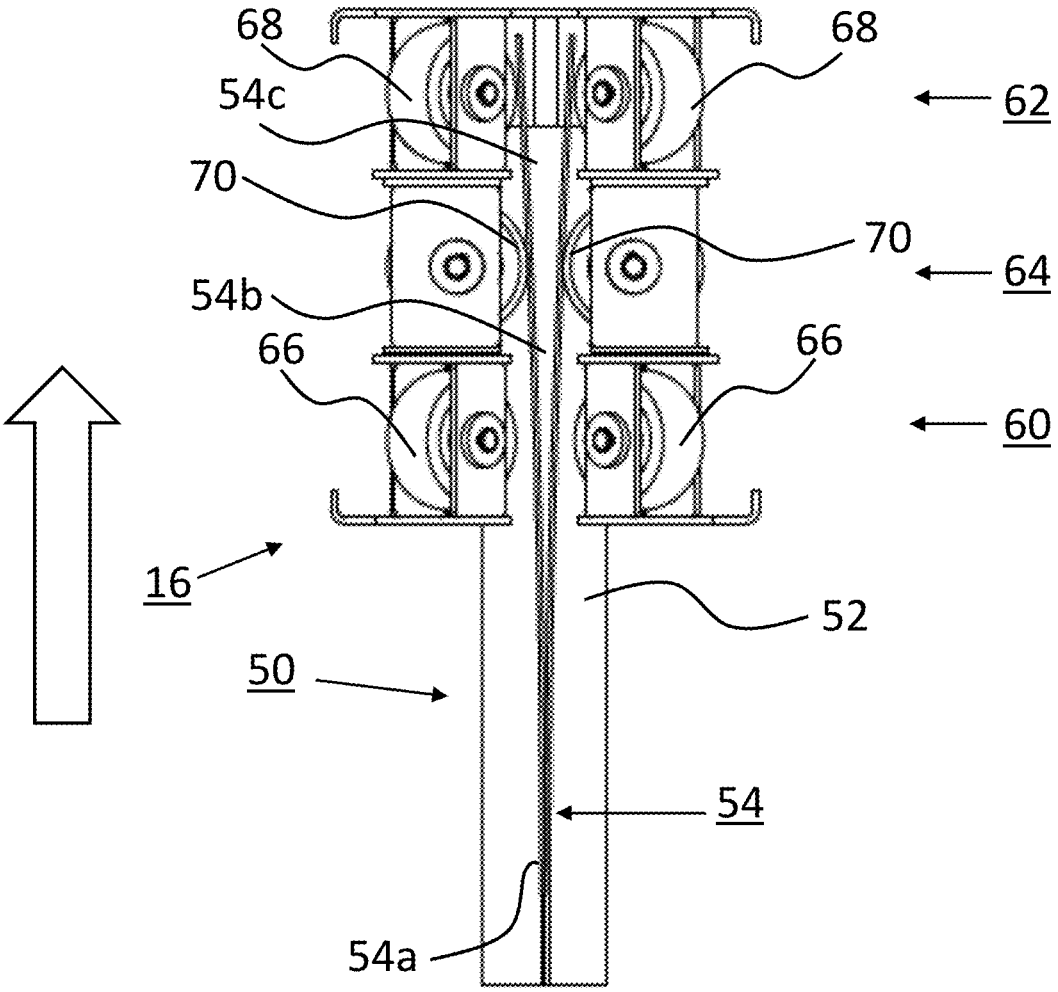
FIG. 14 is a top view of the bogie of FIG. 7 mounted to the track end-segment at a second distance that is less than the first distance away from the end of the track end-segment.
Figure 15:
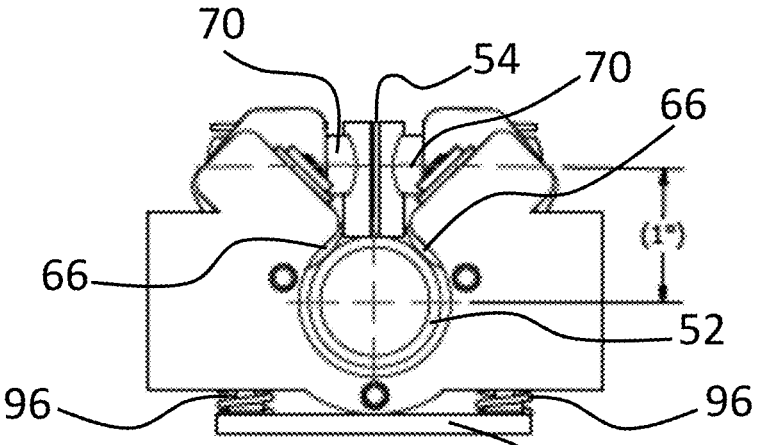
FIG. 15 is an end view of the bogie at the second distance away from the end of the track end-segment.
Figure 16:
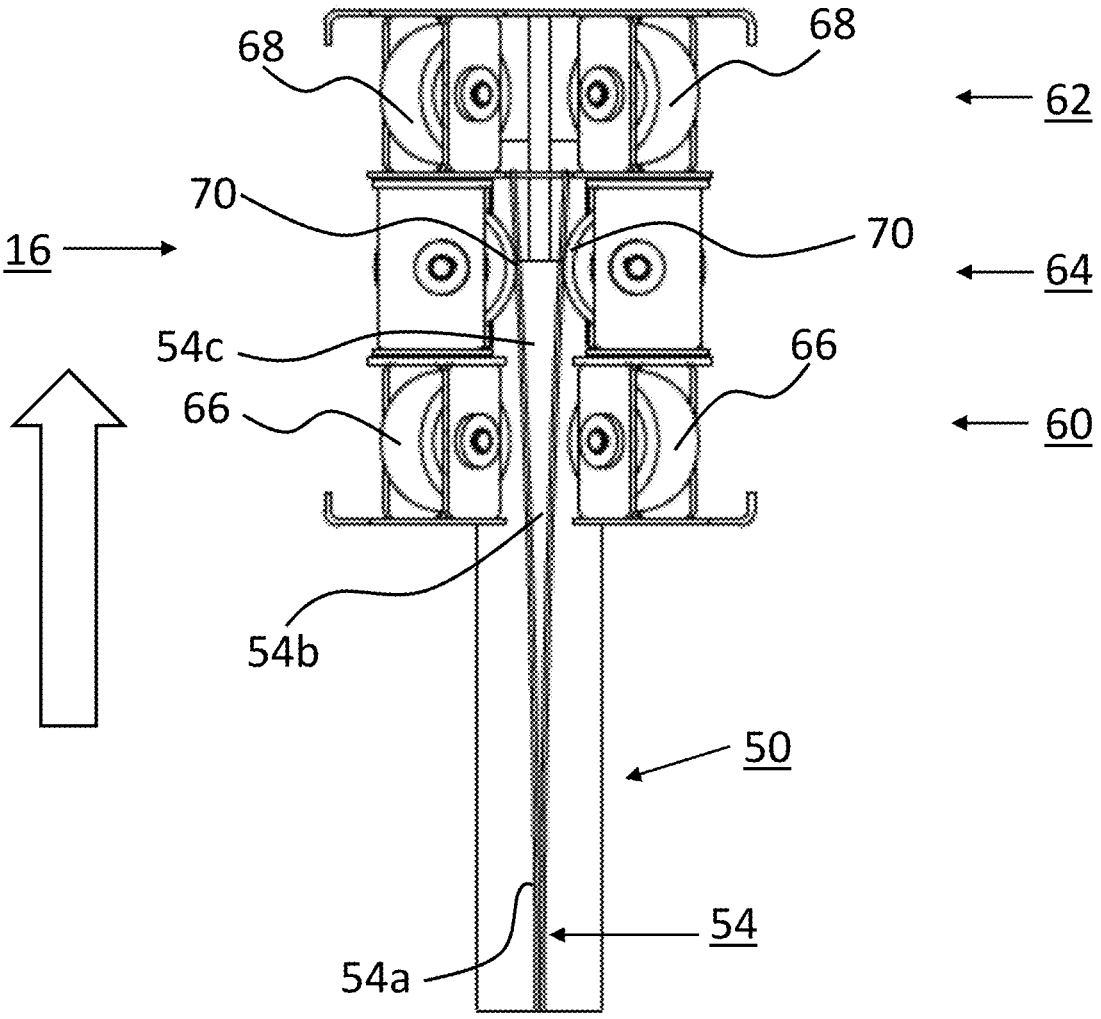
FIG. 16 is a top view of the bogie of FIG. 7 mounted to the track end-segment at a third distance that is less than the second distance away from the end of the track end-segment.
Figure 17:
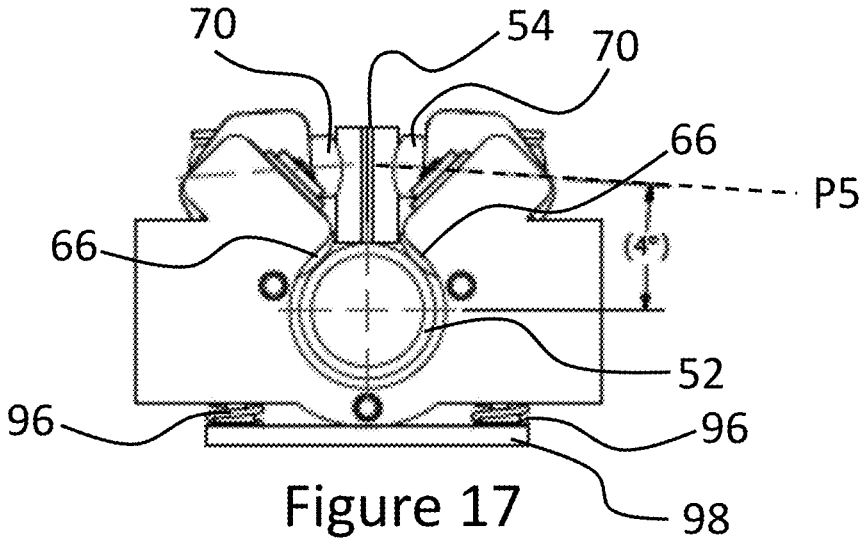
FIG. 17 is an end view of the bogie at the third distance away from the end of the track end-segment.

FIGS. 12-17 illustrate the passive braking that occurs when the bogie 16 moves along the end-segment 50 of the track 12. FIGS. 12, 14 and 16 are top views showing the bogie 16 mounted on the end-segment 50 at increasingly smaller distances from the end of the track 12, and FIGS. 13, 15 and 17 are corresponding end views showing the bogie 16 mounted on the end-segment 50 at the same locations that are represented in FIGS. 12, 14 and 16, respectively. The block arrow in FIGS. 12, 14 and 16 indicates the direction of travel of the bogie 16 toward the end of the track 12.

In FIGS. 12 and 13 the second lateral wheels 70 of the bogie 16 are proximate the first end 54*a* of the end-segment 50, which is connected to the central section of the track 12. The width of the flange 54 at the first end 54*a* is the same as the width of the flange in the central section of the track 12, and the second lateral wheels 70 are in their respective first positions such that the compression springs 96 are not compressed. As is shown in FIG. 13, when the second lateral wheels 70 are in their respective first positions they rotate within a plane P4 that is generally perpendicular to the vertical center plane, in particular plane P4 is angled upwardly from a normal to the vertical center plane P1 by approximately 6° in this specific and non-limiting example. The second lateral wheels 70 may be adjusted during installation to be slightly out of contact with the flange 54 within the central section of the track 12 and within the first end 54*a* of the end-segment 50, such that contact between the second lateral wheels 70 and the flange 54 occurs only if the rider support undergoes lateral swaying that causes the bogie 16 to rotate on the track. If the bogie 16 rotates in the clock-wise direction in FIG. 13, then the second lateral wheel 70 on the left-hand side of the bogie 16 will come into contact with and will run along the left-hand side of the flange 54. As the bogie 16 continues to rotate in the clock-wise direction, the compression springs 96 mounted below the left-hand side second lateral wheel 70 will begin to compress. Eventually a limit of compression will be reached and the rotational motion of the bogie 16 will stop, thereby preventing an over-rotation of the bogie 16.

FIGS. 14 and 15 show the second lateral wheels 70 of the bogie 16 within the intermediate region 54*b* of the end-segment 50. As discussed supra with reference to FIGS. 6A-E, the width of the flange 54 increases along the length of the intermediate region 54*b* such that as the bogie 16 moves through the intermediate region 54*b* toward the end of the track 12, the second lateral wheels 70 begin to make contact with and then roll along the opposite sides of the flange 54. As the second lateral wheels 70 roll along the increasingly wide flange 54, they are caused to pivot outwardly and away from the central vertical plane P1 of the bogie 16, which places an increasing compressive load on the compression springs 96. The restoring force that is exerted by the compression springs 96 also increases as the bogie 16 moves through the intermediate region 54*b* of the end-segment 50, which causes the second lateral wheels to squeeze the flange 54 as they run along the opposite sides thereof. The clamping force applied by the second lateral wheels 70 slows the forward movement of the bogie 16, resulting in a passive braking action within the end-segment 50.

FIGS. 16 and 17 show the bogie 16 with the second lateral wheels 70 proximate the second end 54*c* of the end-segment 50. The flange 54 has its maximum width at the second end 54*c*, which is approximately equal to, and preferably greater than, the maximum separation between the second lateral wheels 70 when the second lateral wheels 70 are in their respective second positions. As is shown in FIG. 17, the second lateral wheels 70 rotate within a plane P5 that is angled downwardly from a normal to the vertical center plane P1 by approximately 4°.

Compression springs 96 are compressed when the bogie 16 is located within the second end 54*c* of the end segment 50. As a result, the compression springs 96 exert a strong restoring force on the second lateral wheels 70, which increases the rolling resistance as the second lateral wheels 70 roll along the flange 54 within the second end 54*c* of the end segment 50. The rolling resistance acts opposite the direction of travel indicated by the block arrow and is therefore a passive braking that slows the forward speed of the bogie 16 as the bogie 16 approaches the end of the track 12. The passive braking action described above does not require the rider to perform any action as it is actuated by the flange 54 within the end-segment 50. Advantageously, the passive braking described above cannot be easily defeated by the rider since during use the bogie 16 is at least partially enclosed by a housing and thus tampering is difficult.

Figure 18:
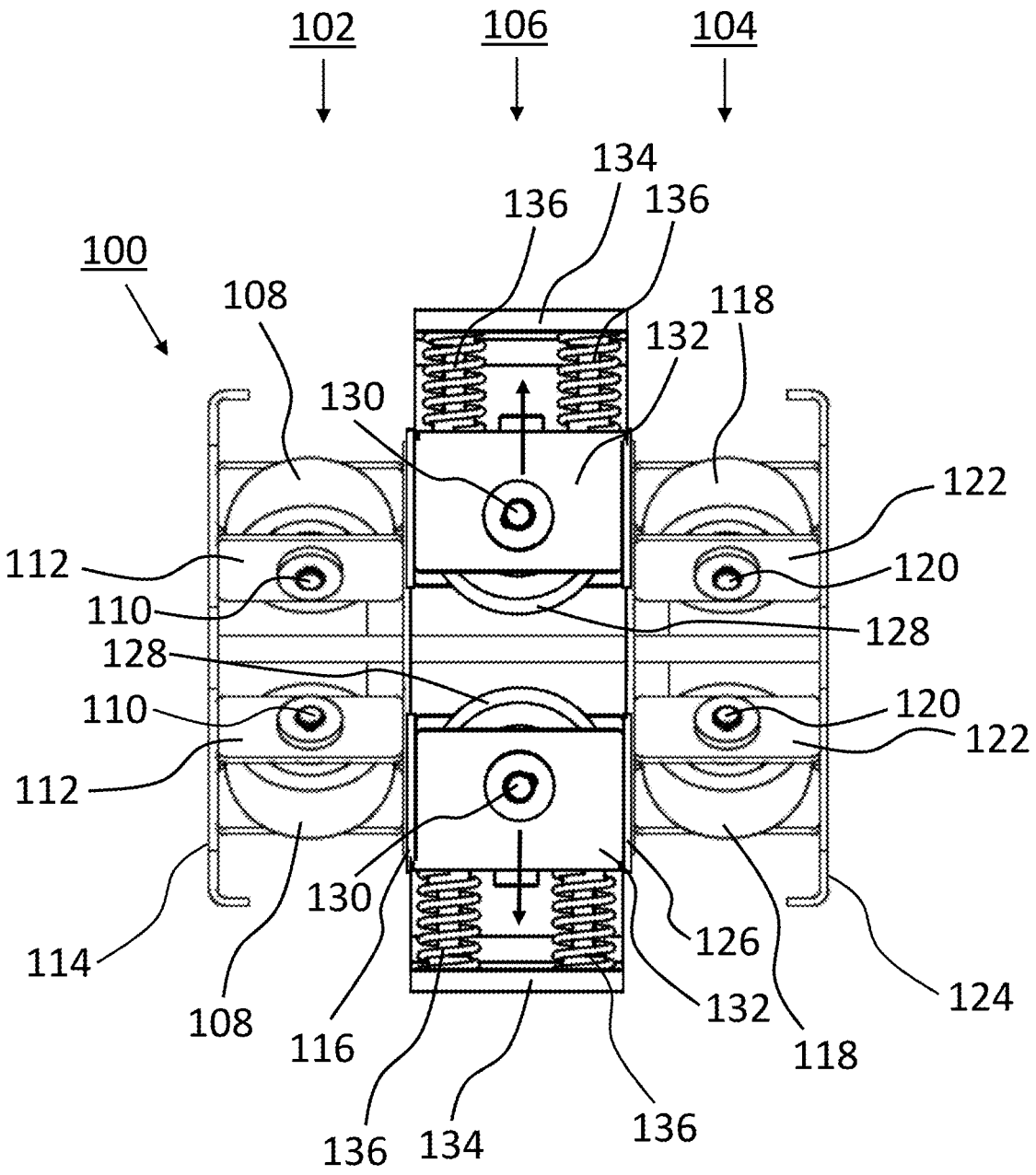
FIG. 18 is a simplified top view of another bogie that is suitable for use with the amusement ride system of FIG. 1, shown without an external housing.

FIG. 18 is a top view showing an alternative bogie 100, which is suitable for use with the amusement ride system 10 of FIG. 1. The bogie 100 is shown without an external housing in order to better illustrate the internal components thereof. During use, a plastic or a metal housing at least partially encloses the bogie 100 for safety reasons and also to prevent sand and other contaminants from damaging the internal components thereof.

In the specific example that is shown in FIG. 18, the bogie 100 includes first and second end subassemblies 102 and 104 and a middle subassembly 106. The first end subassembly 102 includes a pair of first lateral wheels 108 rotatably mounted, via respective axles 110, to first lateral wheel surfaces 112 that are disposed between, and that are supported by, an end plate 114 and a first inner wall 116. Similarly, the second end subassembly 104 includes a pair of first lateral wheels 118 rotatably mounted, via respective axles 120, to first lateral wheel surfaces 122 that are disposed between, and that are supported by, an end plate 124 and a second inner wall 126.

The middle subassembly 106 includes a pair of second lateral wheels 128 rotatably mounted via a respective axle 130 to second lateral wheel surfaces 132 that are slidably mounted to a frame 134 via a pair of compression springs 136. The frame 134 is disposed between, and is supported by, the first inner wall 116 and the second inner wall 126. Sliding movement of the second lateral wheels 128 away from the center of the bogie 100, i.e. in the direction indicated by the arrows, compresses the compression springs 136. The compression springs 136 thereafter exert a restoring force on the second lateral wheels 128 via the second lateral wheel surfaces 132, the magnitude of which increases as the second lateral wheels 128 continue the sliding movement in the direction of the arrows and further compress the compression springs 136.

The bogie 100 includes a not illustrated mounting structure for coupling with a complementary mounting structure of a rider support 17. The rider support 17 may optionally take the form of a seat or disc that is capable of supporting a single rider or a plurality of riders, or the rider support 17 may take the form of a ring or a T-bar that is gripped by the rider, etc.

During use, the first lateral wheels 108 and 118 roll along the run of the track 12 of the amusement ride system 10, and the second lateral wheels 128 function similarly to the second lateral wheels 70, as discussed supra with reference to FIGS. 7-17. In particular, the second lateral wheels 128 are normally spaced away from the flange of the track 12 within the central section thereof and only roll along the sides of the flange when the bogie 100 is subjected to a rotational motion, such as may be caused by a side-to-side swaying motion of a rider support suspended below the bogie 100. As such, the second lateral wheels 128 limit the rotational motion of the bogie 100 and prevent an over-rotation of the bogie 100. Further, the second lateral wheels 128 roll along the sides of the flange within the end-segment 50 and slide outwardly in response to the increasing width of the flange within the intermediate region 54*b*, thereby compressing the compression springs 136. As a result, the compression springs 136 exert a strong restoring force on the second lateral wheels 128, which increases the rolling resistance as the second lateral wheels 128 roll along the flange 54 within the second end 54*c* of the end segment 50. The rolling resistance acts opposite the direction of travel of the bogie 100 and is therefore a passive braking that slows the forward speed of the bogie 100 as the bogie 100 approaches the end of the track 12. The passive braking action described above does not require the rider to perform any action as it is actuated by the flange 54 within the end-segment 50. Advantageously, the passive braking described above cannot be easily defeated by the rider since during use the bogie 100 is at least partially enclosed by a housing and thus tampering is difficult.

Figure 19:
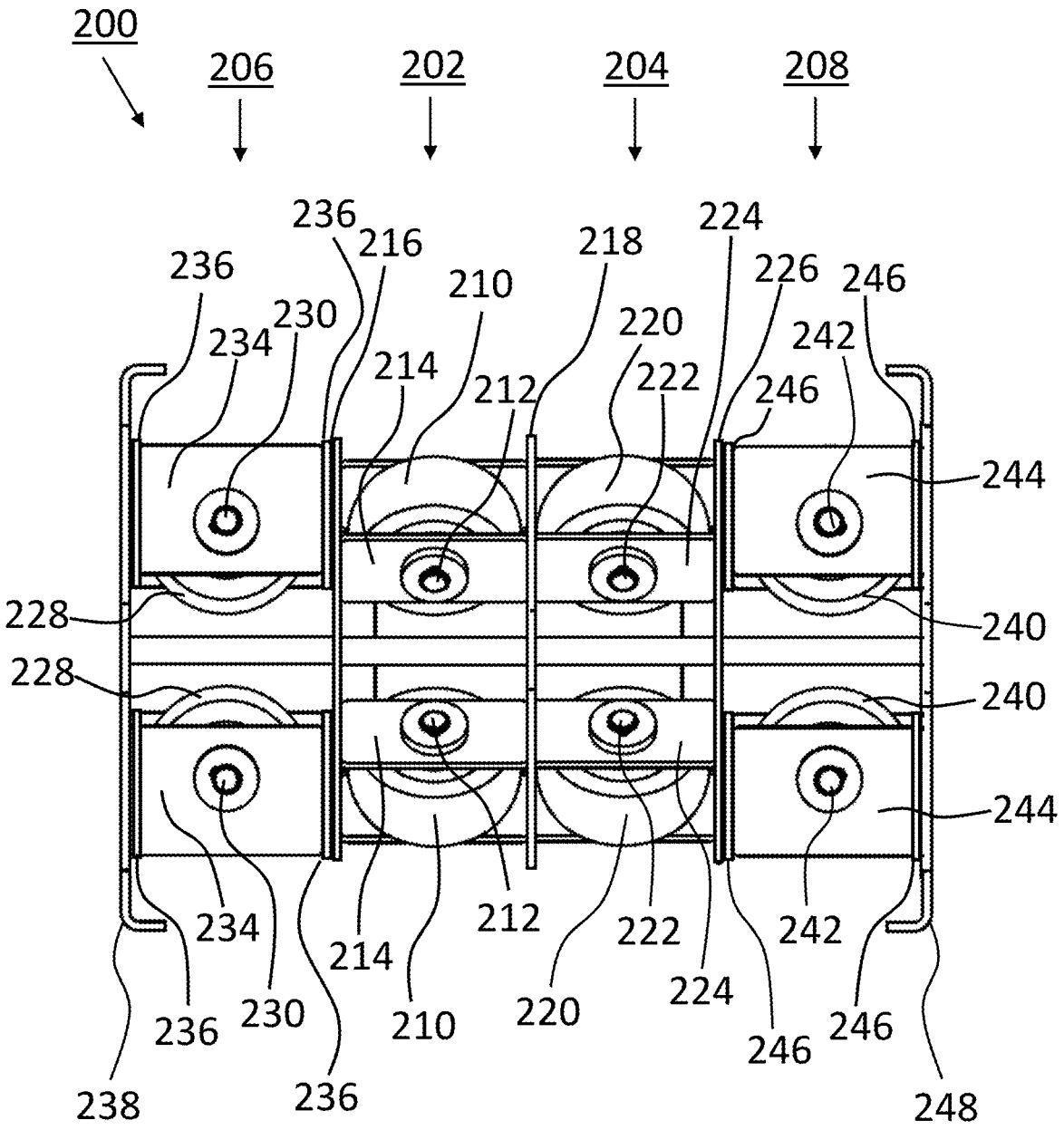
FIG. 19 is a simplified top view of yet another bogie that is suitable for use with the amusement ride system of FIG. 1, shown without an external housing.

FIG. 19 is a top view showing an alternative bogie 200, which is suitable for use with the amusement ride system 10 of FIG. 1. The bogie 200 is shown without an external housing in order to better illustrate the internal components thereof. During use, a plastic or a metal housing at least partially encloses the bogie 200 for safety reasons and also to prevent sand and other contaminants from damaging the internal components thereof.

In the specific example that is shown in FIG. 19, the bogie 200 includes first and second middle subassemblies 202 and 204 and first and second end subassemblies 206 and 208. Each of the first and second middle subassemblies 202 and 204 is substantially similar to the first and second end subassemblies 60 and 62 described with reference to FIG. 7. Additionally, each of the first and second end subassemblies 206 and 208 is similar to the middle subassembly 64 described with reference to FIG. 7.

The first middle subassembly 202 includes a pair of first lateral wheels 210 rotatably mounted, via respective axles 212, to first lateral wheel surfaces 214 that are disposed between, and that are supported by, a first inner wall 216 and a middle wall 218. Similarly, the second middle subassembly 204 includes a pair of first lateral wheels 220 rotatably mounted, via respective axles 222, to first lateral wheel surfaces 224 that are disposed between, and that are supported by, a second inner wall 226 and the middle wall 218.

The first end subassembly 206 includes a pair of second lateral wheels 228 rotatably mounted via a respective axle 230 to second lateral wheel surfaces 234 that are disposed between, and that are supported by, vertical supports 236. The vertical supports 236 are pivotably coupled to a not illustrated base element similar to base element 94 in FIG. 7, the not illustrated base element is mounted onto a not illustrated support plate similar to the support plate 98 of FIG. 7, via a pair of not illustrated compression springs similar to compression springs 96 of FIG. 7. The vertical supports 236 are pivotably mounted between a first end plate 238 and the first inner wall 216, such that a pivoting movement of the second lateral wheels 228 causes the not illustrated base element to move toward the not illustrated support plate and thereby compress the not illustrated compression springs. The not illustrated compression springs exert a restoring force on the not illustrated base element, the magnitude of which increases as the second lateral wheels 228 continue to pivot and compress the not illustrated compression springs.

The second end subassembly 208 includes a pair of second lateral wheels 240 rotatably mounted via a respective axle 242 to second lateral wheel surfaces 244 that are disposed between, and that are supported by, vertical supports 246. The vertical supports 246 are pivotably coupled to a not illustrated base element similar to base element 94 in FIG. 7, the not illustrated base element is mounted onto a not illustrated support plate similar to the support plate 98 of FIG. 7, via a pair of not illustrated compression springs similar to compression springs 96 of FIG. 7. The vertical supports 246 are pivotably mounted between a second end plate 248 and the second inner wall 226, such that a pivoting movement of the second lateral wheels 240 causes the not illustrated base element to move toward the not illustrated support plate and thereby compress the not illustrated compression springs. The not illustrated compression springs exert a restoring force on the not illustrated base element, the magnitude of which increases as the second lateral wheels 240 continue to pivot and compress the not illustrated compression springs.

The bogie 200 includes a not illustrated mounting structure for coupling with a complementary mounting structure of a rider support 17. The rider support 17 may optionally take the form of a seat or disc that is capable of supporting a single rider or a plurality of riders, or the rider support 17 may take the form of a ring or a T-bar that is gripped by the rider, etc.

During use, the first lateral wheels 210 and 220 roll along the run of the track 12 of the amusement ride system 10, and the second lateral wheels 228 and 240 function similarly to the second lateral wheels 70, as discussed supra with reference to FIGS. 7-17. In particular, the second lateral wheels 228 and 240 are normally spaced away from the flange of the track 12 within the central section thereof and only roll along the sides of the flange when the bogie 200 is subjected to a rotational motion, such as may be caused by a side-to-side swaying motion of a rider support suspended below the bogie 200. As such, the second lateral wheels 228 and 240 limit the rotational motion of the bogie 200 and prevent an over-rotation of the bogie 200. Further, the second lateral wheels 228 and 240 roll along the sides of the flange within the end-segment 50, and pivot outwardly in response to the increasing width of the flange within the intermediate region 54*b*, thereby compressing the not illustrated compression springs. The restoring force exerted by the not illustrated compression springs causes the second lateral wheels 228 and 240 to squeeze against the flange 54 and provide a passive braking effect. Since the second lateral wheels are disposed at the opposite ends of the bogie 200, in practice only one set of second lateral wheels will provide the passive braking effect within the end-segment 50 at each end of the track 12. For instance, if the bogie is moving from right-to-left in FIG. 19 then the second lateral wheels 228 will be pivoted outwardly by the flange 54 within the intermediate region 54*b* and the bogie 200 will come to a halt before the second lateral wheels 240 at the trailing end of the bogie undergo a significant amount of pivoting movement such that the braking action exerted thereby, if any, is minimal.

In the description of the invention herein, it is understood that a word appearing in the singular encompasses its plural counterpart, and a word appearing in the plural encompasses its singular counterpart, unless implicitly or explicitly understood or stated otherwise. For instance, unless the context indicates otherwise, a singular reference, such as "a" or "an" means "one or more". Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding.

Throughout the description and claims of this specification, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example", "e.g." and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. An amusement ride system, comprising:

a track having first and second opposite end sections and a central section disposed therebetween, the track comprising a run and a flange extending from an upper portion of the run, the flange having a width within the central section of the track, wherein the width of the flange increases within at least one of the first and second opposite end sections of the track to a maximum flange width; and a bogie configured to move along the track, the bogie having a vertical center plane and having an upper opening extending along a length thereof for accommodating the flange, the bogie comprising:

two first lateral wheels rotatably mounted on each side of the vertical center plane, the two first lateral wheels being arranged to roll along the run of the track;

a second lateral wheel rotatably mounted on each side of the vertical center plane; and a mechanism configured to normally bias the second lateral wheel on each side of the vertical center plane toward a respective first position that is proximate the vertical center plane and to support a movement of each of the second lateral wheels toward a respective second position that is spaced away from the vertical center plane, wherein the second lateral wheel disposed on one side of the vertical center plane is spaced apart from the second lateral wheel disposed on the other side of the vertical center plane by:

a first distance when each second lateral wheel is in its respective first position, and a second distance greater than the first distance when each second lateral wheel is in its respective second position, and wherein the second distance is less than the maximum flange width within the at least one of the first and second opposite end sections.

2. The amusement ride system of claim 1, wherein, on each side of the vertical center plane, the second lateral wheel is disposed between the two first lateral wheels along the length of the bogie.

3. The amusement ride system of claim 1, wherein the central section of the track has a length and the width of the flange is uniform along the length of the central section of the track, and wherein the first distance is equal to or greater than the uniform width of the flange.

4. The amusement ride system of claim 1, wherein, on each side of the vertical center plane, the second lateral wheel is arranged to rotate in a plane that is oriented generally perpendicular to the vertical center plane at least when the second lateral wheel is in the first position.

5. The amusement ride system of claim 1 wherein the mechanism comprises at least one compression spring.

6. The amusement ride system of claim 5, wherein, on each side of the vertical center plane, the mechanism is configured to support a pivoting movement of the second lateral wheel relative to the vertical center plane, and wherein the at least one compression spring is configured to provide a restoring force that increases as the second lateral wheel moves toward the second position.

7. The amusement ride system of claim 5, wherein, on each side of the vertical center plane, the mechanism is configured to support a generally linear translational movement of the second lateral wheel relative to the vertical center plane, and wherein the at least one compression spring is configured to provide a restoring force that increases as the second lateral wheel moves toward the second position.

8. The amusement ride system of claim 1, wherein the bogie comprises a mounting structure for coupling with a complementary mounting structure carried by a rider support, for suspending the rider support below the bogie when the bogie is mounted on the track above a ground surface.

9. An amusement ride system, comprising:

a substantially rigid track supported above a ground surface by a plurality of supports, the track comprising a plurality of track segments connected together such that adjacent track segments have substantially no freedom of movement relative to each other, and such that a junction between adjacent track segments presents a substantially smooth, continuous, and uninterrupted surface, each track segment comprising a run and a flange extending from an upper portion of the run, the track having first and second opposite end sections and a central section disposed therebetween, wherein the flange has a width that is substantially uniform within the central section of the track and wherein the width of the flange increases within at least one of the first and second opposite end sections of the track from the uniform width to a maximum flange width; and a bogie configured to move along the track, the bogie having a vertical center plane and having an upper opening extending along a length thereof for accommodating the flange, the bogie comprising:

two first lateral wheels rotatably mounted on each side of the vertical center plane, the two first lateral wheels being arranged to rotate in a first plane that is oriented at an angle of between about 0° and about 60° relative to the vertical center plane;

a second lateral wheel rotatably mounted on each side of the vertical center plane, each second lateral wheel being movable along an arcuate path or along a direction that is generally perpendicular to the vertical center plane, between a respective first position that is proximate the vertical center plane and a respective second position that is spaced-away from the vertical center plane; and a mechanism configured to provide a force that normally biases each of the second lateral wheels toward the respective first position, wherein, on each side of the vertical center plane, the second lateral wheel is arranged to rotate in a respective second plane that is oriented generally perpendicular to the vertical center plane at least when the second lateral wheel is in the first position, and wherein a space between the second lateral wheel on one side of the vertical center plane and the second lateral wheel on the other side of the vertical center plane increases with the width of the flange when the bogie moves through the at least one of the first and second opposite end sections of the track, and wherein the force provided by the mechanism increases with the increasing space, thereby increasing rolling resistance between the second lateral wheels and the flange.

10. The amusement ride system of claim 9, wherein, on each side of the vertical center plane, the second lateral wheel is disposed between the two first lateral wheels along the length of the bogie.

11. The amusement ride system of claim 9, wherein the mechanism comprises a compression spring.

12. The amusement ride system of claim 11, wherein, on each side of the vertical center plane, the mechanism is configured to support a pivoting movement of the second lateral wheel relative to the vertical center plane, and wherein the compression spring is configured to provide a restoring force that increases as the second lateral wheel moves toward the second position.

13. The amusement ride system of claim 11, wherein, on each side of the vertical center plane, the mechanism is configured to support a generally linear translational movement of the second lateral wheel relative to the vertical center plane, and wherein the compression spring is configured to provide a restoring force that increases as the second lateral wheel moves toward the second position.

14. The amusement ride system of claim 9, wherein the bogie comprises a mounting structure for coupling with a complementary mounting structure carried by a rider support, for suspending the rider support below the bogie when the bogie is mounted on the track above a ground surface.

15. The amusement ride system of claim 9, wherein the bogie comprises an additional second lateral wheel rotatably mounted on each side of the vertical center plane, each additional second lateral wheel being movable along an arcuate path or along a direction that is generally perpendicular to the vertical center plane, between a first position that is proximate the vertical center plane and a second position that is spaced-away from the vertical center plane, and wherein, on each side of the vertical center plane, the two first lateral wheels are disposed between the second lateral wheel and the additional second lateral wheel along the length of the bogie.

16. A bogie configured to move along a track of an amusement ride, the bogie having a vertical center plane thereof, the bogie comprising:

two first lateral wheels rotatably mounted on each side of the vertical center plane, the two first lateral wheels being arranged to rotate in a first plane that is oriented at an angle of between about 0° and about 60° relative to the vertical center plane;

a second lateral wheel rotatably mounted on each side of the vertical center plane, each second lateral wheel being movable along an arcuate path or along a direction that is generally perpendicular to the vertical center plane, between a respective first position that is proximate the vertical center plane and a respective second position that is spaced-away from the vertical center plane, each second lateral wheel being arranged to rotate in a respective second plane that is oriented generally perpendicular to the vertical center plane at least when each second lateral wheel is in the respective first position thereof; and a mechanism configured to provide a force that normally biases each second wheel toward the respective first position thereof, and wherein the mechanism is further configured such that the magnitude of the provided force increases with increasing separation between the second lateral wheel on one side of the vertical center plane and the second lateral wheel on the other side of the vertical center plane, wherein, on each side of the vertical center plane, the second lateral wheel is disposed between the two first lateral wheels along a length of the bogie, and further comprising:

on each side of the vertical center plane, a first lateral wheel surface disposed proximate a first end of the bogie and a second lateral wheel surface disposed proximate a second end of the bogie that is opposite the first end, and wherein the two first lateral wheels are rotatably mounted one each to a respective one of the first and second lateral wheel surfaces.

17. The bogie of claim 16, wherein the mechanism comprises at least one compression spring.

18. The bogie of claim 17, wherein, on each side of the vertical center plane, the at least one compression spring is configured to provide a restoring force that increases in magnitude as the second lateral wheel moves toward the second position.

19. The bogie as claimed in claim 16, comprising, on each side of the vertical center plane, a third lateral wheel surface to which the second lateral wheel on the same side of the vertical center plane is rotatably mounted, and wherein, on each side of the vertical center plane, the mechanism is configured to support a pivoting movement of the third lateral wheel surface relative to the vertical center plane such that an inclination of the second plane varies relative to the vertical center plane when each second lateral wheel is moved between the respective first position thereof and the respective second position thereof.

20. The bogie as claimed in claim 16, comprising, on each side of the vertical center plane, a third lateral wheel surface to which the second lateral wheel on the same side of the vertical center plane is rotatably mounted, and wherein, on each side of the vertical center plane, the mechanism is configured to support a generally linear translational movement of the third lateral wheel surface relative to the vertical center plane such that an inclination of each third lateral wheel surface does not vary relative to the vertical center plane when the respective second lateral wheel is moved between the respective first position thereof and the respective second position thereof.

21. A bogie configured to move along a track of an amusement ride, the bogie having a vertical center plane thereof, the bogie comprising:

two first lateral wheels rotatably mounted on each side of the vertical center plane, the two first lateral wheels being arranged to rotate in a first plane that is oriented at an angle of between about 0° and about 60° relative to the vertical center plane;

a second lateral wheel rotatably mounted on each side of the vertical center plane, each second lateral wheel being movable along an arcuate path or along a direction that is generally perpendicular to the vertical center plane, between a respective first position that is proximate the vertical center plane and a respective second position that is spaced-away from the vertical center plane, each second lateral wheel being arranged to rotate in a respective second plane that is oriented generally perpendicular to the vertical center plane at least when each second lateral wheel is in the respective first position thereof; and a mechanism configured to provide a force that normally biases each second wheel toward the respective first position thereof, and wherein the mechanism is further configured such that the magnitude of the provided force increases with increasing separation between the second lateral wheel on one side of the vertical center plane and the second lateral wheel on the other side of the vertical center plane, and further comprising an additional second lateral wheel rotatably mounted on each side of the vertical center plane, each additional second lateral wheel being movable along an arcuate path or along a direction that is generally perpendicular to the vertical center plane, between a first position that is proximate the vertical center plane and a second position that is spaced-away from the vertical center plane, and wherein, on each side of the vertical center plane, the two first lateral wheels are disposed between the second lateral wheel and the additional second lateral wheel along a length of the bogie.

* * * * *